US010726693B2

(12) United States Patent
Alicot et al.

(10) Patent No.: US 10,726,693 B2
(45) **Date of Patent: *Jul. 28, 2020**

(54) MULTI-TECHNOLOGY TRANSPONDER AND SYSTEM

(71) Applicant: Sensormatic Electronics, LLC, Boca Raton, FL (US)

(72) Inventors: Jorge F. Alicot, Davie, FL (US); Alan Day, Pembroke Pines, FL (US); Charles T. Turgeon, Lighthouse Point, FL (US)

(73) Assignee: SENSORMATIC ELECTRONICS, LLC, Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/986,519

(22) Filed: May 22, 2018

(65) Prior Publication Data

US 2018/0276965 A1 Sep. 27, 2018

Related U.S. Application Data

(63) Continuation of application No. 14/790,215, filed on Jul. 2, 2015, now Pat. No. 9,978,235.

(51) Int. Cl.
*G08B 13/24* (2006.01)
*E05B 73/00* (2006.01)

(52) U.S. Cl.
CPC ..... *G08B 13/2434* (2013.01); *E05B 73/0017* (2013.01); *E05B 73/0064* (2013.01)

(58) Field of Classification Search
CPC . G01V 15/00; E05B 73/0017; E05B 73/0047; E05B 73/00
See application file for complete search history.

(56) References Cited

U.S. PATENT DOCUMENTS 4,742,341 A * 5/1988 Hogen Esch ..... E05B 73/0017 340/572.2
5,068,641 A * 11/1991 Hogen Esch ..... E05B 73/0017 340/551
5,504,474 A * 4/1996 Libman ..... G06K 19/07762 340/573.4
5,939,984 A * 8/1999 Brady ..... G06K 19/041 340/10.1

(Continued)

*Primary Examiner* — Hai Phan
*Assistant Examiner* — Son M Tang
(74) *Attorney, Agent, or Firm* — Arent Fox LLP

(57) ABSTRACT

A security tag includes a tag body and a cooperating tack assembly having a tack head and an elongated pin extending from the tack head, with the pin being insertable into the tag body to secure an article therebetween. One or more electronic components and associated electrical circuits, including wireless communications modules and various types of sensors, are disposed in both the tack head and tag body. The tack head includes a battery and an energy harvesting circuit. The tack head pin has one or more discrete conductive segments which, when the pin is inserted into the tag body, electrically couple with electrical circuits disposed in the tag body, thus allowing the components in the tag body to be powered at least in part by the battery and/or the energy harvesting circuit disposed in the tack head. Methods for operating the tag to perform security functions are also disclosed.

17 Claims, 7 Drawing Sheets

(56) References Cited

U.S. PATENT DOCUMENTS 5,942,978 A * 8/1999 Shafer ..... E05B 73/0017 340/10.5
5,955,951 A * 9/1999 Wischerop ..... E05B 73/0017 340/10.42
5,977,877 A * 11/1999 McCulloch ..... G08B 21/22 340/572.8
5,990,794 A * 11/1999 Alicot ..... G08B 13/242 235/383
6,043,746 A * 3/2000 Sorrells ..... G06K 19/07749 340/572.1
7,394,382 B2 * 7/2008 Nitzan ..... G06K 19/0702 340/572.8
7,564,360 B2 * 7/2009 Cote ..... E05B 73/0017 340/572.1
8,072,332 B2 * 12/2011 Forster ..... G06K 19/07749 340/572.3
8,089,362 B2 * 1/2012 Chamandy ..... G01V 15/00 340/572.1
8,674,809 B2 * 3/2014 Bares ..... G06F 1/12 340/10.3
9,390,602 B2 * 7/2016 Patterson ..... E05B 73/0064
9,646,239 B2 * 5/2017 Stewart ..... G06K 19/0709
2004/0233042 A1 * 11/2004 Piccoli ..... E05B 73/0017 340/10.1
2010/0259392 A1 * 10/2010 Chamandy ..... E05B 73/0017 340/572.8
2010/0308970 A1 * 12/2010 Rofougaran ..... H01Q 1/2283 340/10.1
2010/0308998 A1 * 12/2010 Hesch, Jr. ..... E05B 73/0017 340/572.8
2012/0032803 A1 * 2/2012 Copeland ..... G08B 13/2431 340/572.1
2012/0142443 A1 * 6/2012 Savarese ..... A63B 71/06 473/199
2012/0217314 A1 * 8/2012 Vathy ..... E05B 73/0017 235/492
2012/0313758 A1 * 12/2012 Savarese ..... G06K 7/10079 340/10.1
2014/0062672 A1 * 3/2014 Gudan ..... G06K 19/0715 340/10.33

* cited by examiner

MULTI-TECHNOLOGY TRANSPONDER AND SYSTEM

CROSS REFERENCE TO RELATED APPLICATIONS

This application is a continuation of U.S. patent application Ser. No. 14/790,215 filed Jul. 15, 2015, now U.S. Pat. No. 9,978,235 issued May 22, 2018, the entirety of which is incorporated herein by reference.

BACKGROUND OF THE INVENTION

As technology progresses, connectivity and functionality of electronic devices have expanded. This has resulted in rapid advancements in machine-to-machine connectivity and user experience with the electronic devices (e.g., smartphones and tablet personal computers). Operational improvements and value added applications are being achieved by the emergence of cost effective and ubiquitous connectivity. Standardization in the area of communication protocols and security measures is allowing for a rapidly evolving landscape in the retail and other environments.

In retail environments, Electronic Article Surveillance ("EAS") systems are employed. A typical EAS system in a retail setting may comprise a monitoring system and at least one security tag or label attached to an article to be protected from unauthorized removal. The monitoring system establishes a surveillance zone in which the presence of security tags and/or labels can be detected. The surveillance zone is usually established at an access point for the controlled area (e.g., adjacent to a retail store entrance and/or exit). If an article enters the surveillance zone with an active security tag and/or label, then an alarm may be triggered to indicate possible unauthorized removal thereof from the controlled area. In contrast, if an article is authorized for removal from the controlled area, then the security tag and/or label thereof can be deactivated and/or detached therefrom. Consequently, the article can be carried through the surveillance zone without being detected by the monitoring system and/or without triggering the alarm.

The security tags may be reusable, and thus include releasable attachment elements for affixing the security tags to the articles. Such attachment elements are further designed to be releasable by authorized personnel only so that unauthorized removal of the security tags from their articles can be avoided. To this end, many attachment elements are made releasable only through the use of an associated special hook or detaching mechanism.

An exemplary security tag employing an attachment element and an associated detacher is described in U.S. Pat. No. 5,426,419 ("the '419 patent"), entitled SECURITY TAG HAVING ARCUATE CHANNEL AND DETACHER APPARATUS FOR SAME and assigned to the same assignee hereof. The security tag of the '419 patent includes a tag body and an attachment element in the form of a tack assembly. Notably, all of the security tag electronic components are disposed within the tag body. Accordingly, the tack assembly comprises a mechanical component absent of any electronic components.

The tack assembly is used to attach the tag body to an article which is to be protected by the security tag. This is accomplished by inserting a tack into an opening in the tag body. When the tack is fully inserted into the opening, it is releasably secured in the tag body via a releasable locking means. Access to the releasable locking means is through an arcuate channel. With this configuration, a special arcuate probe is needed to reach and release the releasable locking means, and thus detach the security tag from the article.

SUMMARY OF THE INVENTION

The present disclosure concerns implementing systems and methods for operating a security tag. The methods involve: coupling the security tag to an article by at least partially inserting an attachment assembly into a tag body; performing core security tag functions by a first electronic circuit disposed within the tag body of the security tag to protect the article from an unauthorized removal of the article from an area; performing at least one first peripheral security tag function by a second electronic circuit disposed within the attachment assembly of the security tag; and optionally performing at least one second peripheral function by a third electronic circuit exclusively coupled to the attachment assembly when the security tag is not coupled to the article.

In some scenarios, the core security tag functions include at least one of Electronic Article Surveillance ("EAS") functions, Radio Frequency Identification ("RFID") functions and tamper detection functions. The first peripheral security tag function is selected from a plurality of peripheral security tag functions based on an application-specific criteria. The application-specific criteria comprises cost of security tag fabrication, security tag disposability, security tag utilization flexibility, and security tag power saving capability. The plurality of peripheral security tag functions comprise at least one of power supply functions, power supply monitoring functions, sensor functions, sensor network transceiver functions, energy harvesting functions, user interface functions, alarm functions, and tamper detection functions.

In those or other scenarios, the first and second electronic circuits are electrically connected to each other via an elongate tack body extending down and away from a tack head of the attachment assembly. The elongate tack body comprises a plurality of conductive segments separated from each other by a plurality of insulative elements. Each conductive segment contacts a respective electrical contact of a plurality of electrical contacts disposed within the tag body so as to establish an electrical connection between the first and second electronic circuits. At least one of a battery, a battery monitoring circuit, a sensor circuit, an energy harvesting circuit, and an alarm circuit is disposed within a tack head of the attachment assembly.

In those or yet other scenarios, a closed circuit is created between the second and third electronic circuits when the security tag is coupled to the article. In contrast, an open circuit is created between the second and third electronic circuits when the security tag is decoupled from the article.

DESCRIPTION OF THE DRAWINGS

Embodiments will be described with reference to the following drawing figures, in which like numerals represent like items throughout the figures, and in which.

DETAILED DESCRIPTION OF THE INVENTION

Figure 1:
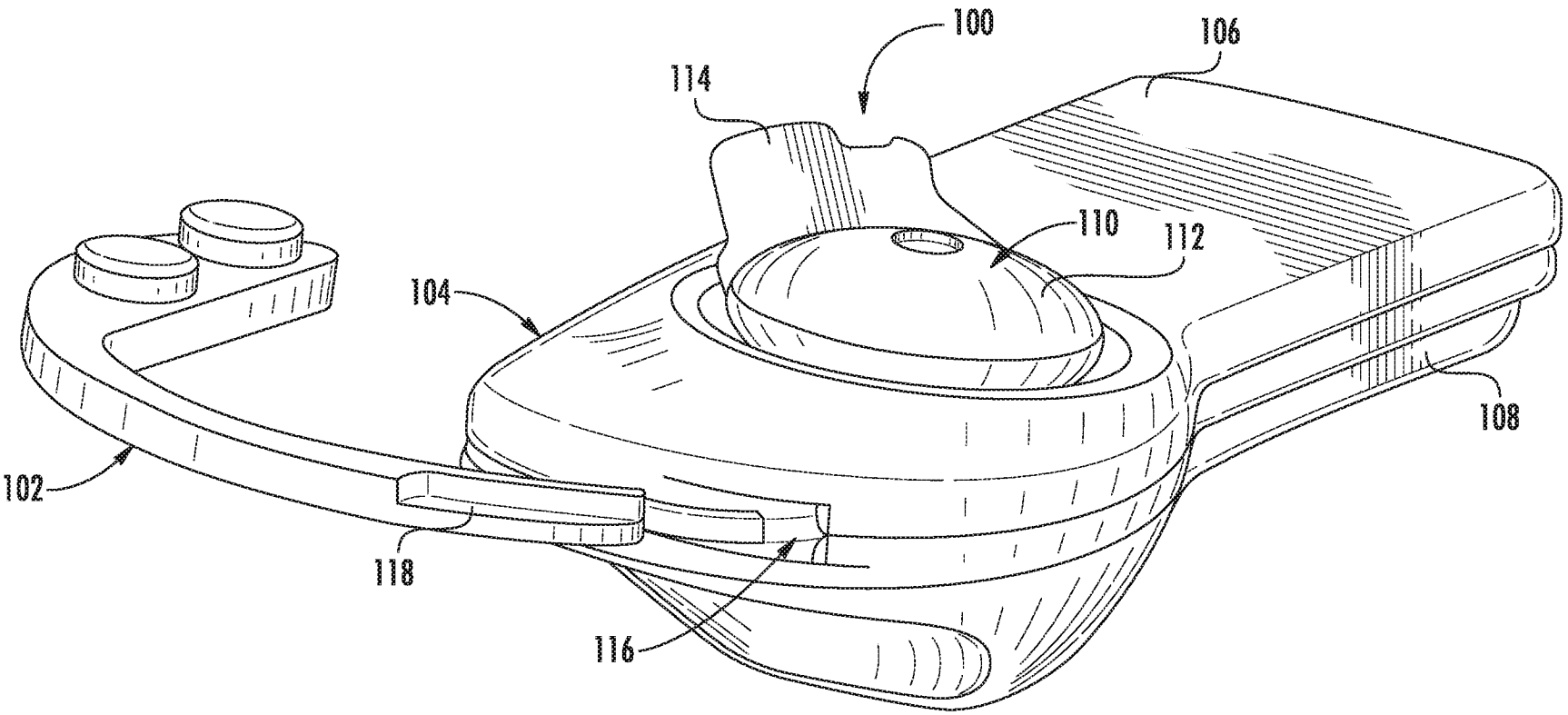
FIG. 1 is a perspective view of an exemplary security tag and detachment mechanism.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

This disclosure concerns systems and methods for providing a multi-technology transponder and system. Security tag functions are modularized. The modularized functions are separated into two tag pieces, namely a tag body and an attachment element (e.g., a tack assembly). The modularized functions interface directly with each other and provide connectivity between the two tag pieces. This connectivity may be a wired or wireless connectivity. Although two tag pieces are described herein, a security tag may contain additional module pieces that directly connect as discussed herein.

The two tag pieces may comprise independent networks, where one network serves a particular application and the second network provides an alternate method of communicating with the security tag. Communication is provided by the modular connectivity between the two networks. Information and actions can be communicated between the different tag modules. For example, a 6LoWPAN network may receive a price update and communicate the information to a Bluetooth smart controller. Also, sensor events occurring in a module can be communicated to other modules.

The systems and methods described herein are applicable to intrusion applications, access applications, home automation applications, and/or other applications where security tag functionality is enhanced by attaching sensors or electronics in a tightly coupled manner. In retail applications, the security tag disclosed herein can be attached to an item so as to provide improved customer experience and desired operational efficiencies.

Figure 2:
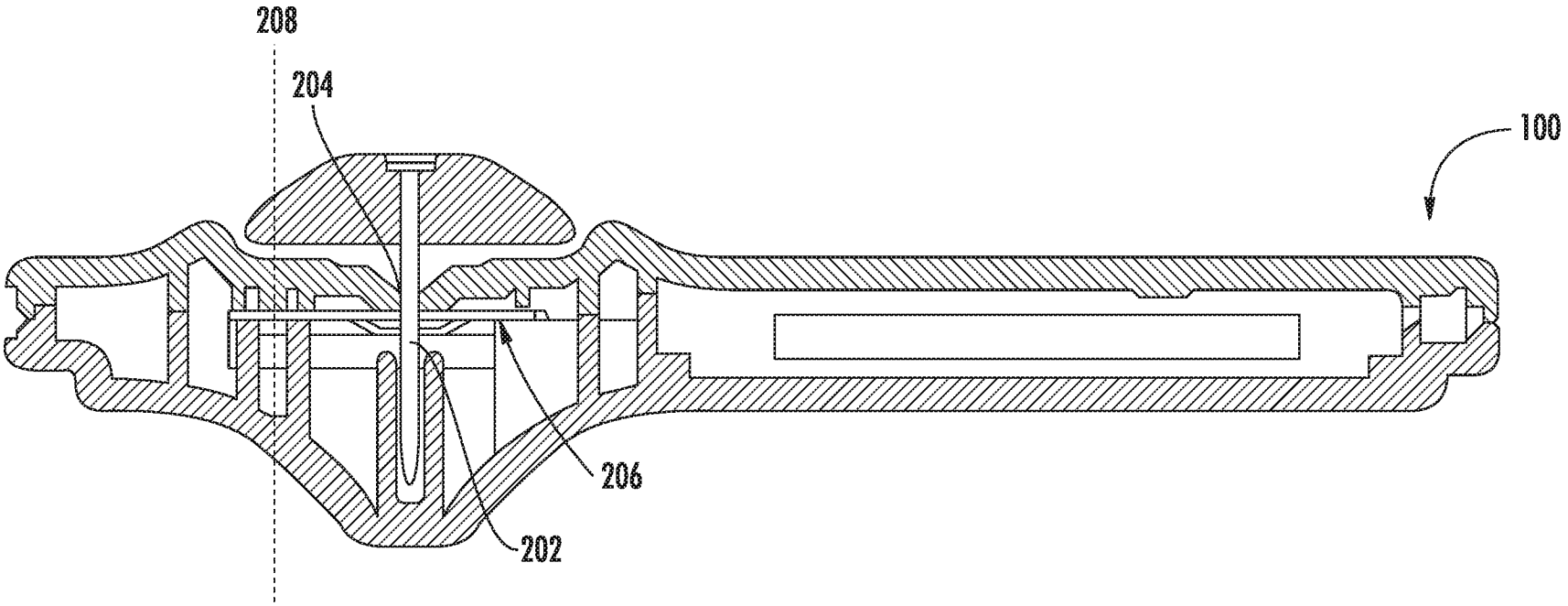
FIG. 2 is a cross sectional side view of the exemplary security tag shown in FIG. 1.

Referring now to FIGS. 1 through 2, there is provided schematic illustrations useful for understanding an exemplary security tag 100 in accordance with the present invention. As shown in FIGS. 1-6, the security tag 100 includes a tag body 104 formed by an upper housing member 106 joined to a lower housing member 108. The housing members 106, 108 can be joined together via an adhesive, a mechanical coupling means (e.g., snaps, screws, etc.), or a weld (e.g., an ultrasonic weld). The tag body 104 can be made from a rigid or semi-rigid material, such as plastic. The tag body 104 has an opening 204 formed therein such that at least a portion of a tack assembly 110 (or attachment element) can be inserted into the security tag for facilitating the attachment of the security tag to an article 114 (e.g., a piece of clothing). EAS and/or Radio Frequency Identification ("RFID") components are contained within the tag body 104. EAS and RFID components of security tags are well known in the art, and therefore will not be described herein. However, it should be understood that the EAS and/or RFID components are extensible to wireless network methods such as Bluetooth and 6oLoWPAN. Other electronic components (e.g., a battery, energy harvesting circuit, sensors, a display and/or alarm output devices) are disposed within or coupled directly to the tack assembly 110, as described below.

Tack assembly 110 has a tack head 112 and an elongate tack body 202 extending down and away from the tack head. The tack body 202 is sized and shaped for insertion into opening 204 and removal from opening 204. A plurality of grooves 406 may be formed along a length of the tack body 202 for engagement with a securement mechanism 206 disposed within the housing 104. When the grooves 406 are engaged by the securement mechanism 206, the security tag 100 is secured to the article 114. The invention is not limited in this regard. For example, in other scenarios the tack body does not have any grooves formed there along. As such, a magnetic securement mechanism (instead of a mechanical securement mechanism) is employed in this case.

Thereafter, unauthorized removal of the article 114 from a controlled area can be detected by a monitoring device of an EAS system. Such monitoring devices are well known in the art, and therefore will not be described herein. Still, it should be understood that at least one sensor (not shown in FIGS. 1-2) is disposed within the housing 104. The sensor includes, but is not limited to, an acoustically resonant magnetic sensor. In all cases, the sensor generates signals which can be detected by the monitoring device.

Such detection occurs when the security tag is present within a surveillance zone established by the monitoring device. The surveillance zone is usually established at an access point for the controlled area (e.g., adjacent to a retail store entrance and/or exit). If the article 114 enters the surveillance zone with the security tag 100, then an alarm may be triggered to indicate possible unauthorized removal thereof from the controlled area. In contrast, if the article 114 is authorized for removal from the controlled area, then the security tag 100 thereof can be deactivated and/or detached therefrom using a detachment mechanism 102 (or external tool). Consequently, the article 114 can be carried through the surveillance zone without being detected by the monitoring system and/or without triggering the alarm.

The detachment mechanism 102 is sized and shaped to at least be partially slidingly inserted into and removed from an insert space 116 formed in the housing 104. When inserted into insert space 116, the detachment mechanism 102 travels through an arcuate channel 500 so as to be guided towards the securement mechanism 206. In this regard, the detachment mechanism 102 has a generally arcuate shape matching that of the arcuate channel 500. Upon engagement with the securement mechanism 206, the detachment mechanism 102 releases the tack body 202 therefrom. Next, the tack body 202 can be removed from the housing, so as to decouple the security tag 100 from the article 114.

As noted above, the security tag 100 comprises a plurality of electronic components. The electronic components include, but are not limited to, an EAS/RFID component, a battery, an energy harvesting circuit, sensors, a display and/or alarm outputs. The electronic components can be selectively disposed within the tag body and/or the tack assembly in accordance with a particular application. Notably, this selective disposition of electronic components provides a tack assembly with a modular form of construction that can be customized to a particular application, whereby overall fabrication costs of security tags are decreased and/or power savings are achieved.

Figure 3:
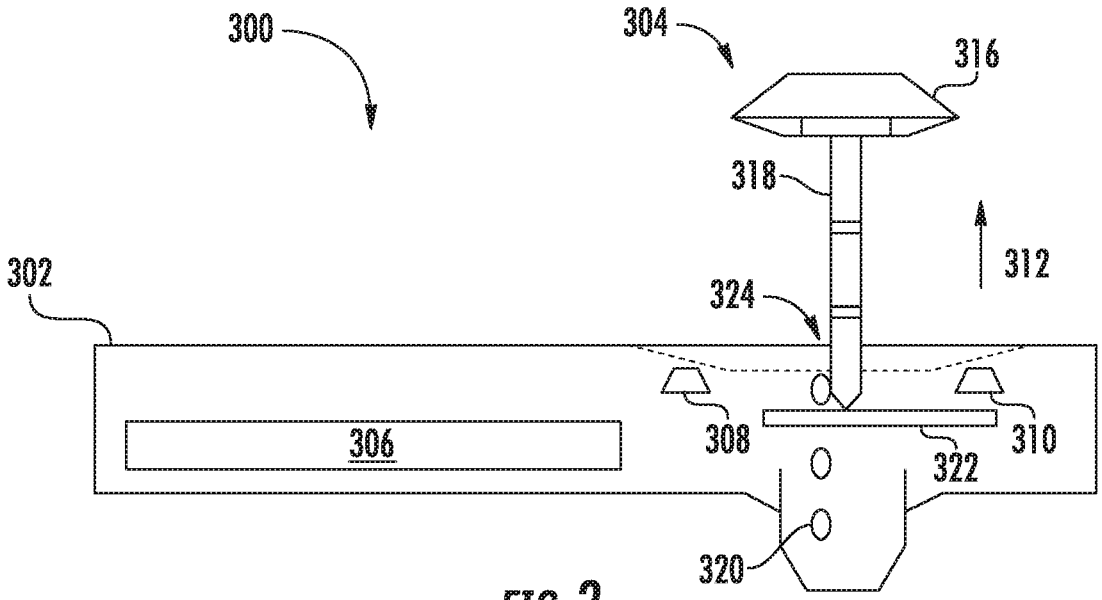
FIG. 3 is an illustration that is useful for understanding an exemplary security tag.

Referring now to FIG. 3, this is provided a schematic illustration of an exemplary security tag 300. Security tag 300 comprises a tag body 302 and a tack assembly 304. Similar to tack body 202 of FIG. 2, the tack assembly 304 is at least partially sized and shaped for insertion into and removal from an opening 324 formed in the tag body 302. A plurality of grooves (not shown in FIG. 3) may be formed along a length of the tack assembly 304 for engagement with a securement mechanism 322 disposed within the tag body 302. When the grooves are engaged by the securement mechanism 322, the security tag 300 is secured to an article (e.g., a piece of clothing). The invention is not limited in this regard. For example, in other scenarios, the tack assembly does not have any grooves formed there along. As such, a magnetic securement mechanism (instead of a mechanical securement mechanism) is employed in this case.

An EAS/RFID component 306 is disposed within the tag body 302. EAS/RFID components are well known in the art, and therefore will not be described herein. Any known or to be known EAS/RFID component can be used herein without limitation. In some scenarios, the EAS/RFID component comprises a transceiver, antenna and processor. The tack assembly 304 may comprise at least a portion of the antenna.

Optional detachment sensors 308, 310 are also disposed within the tag body 302. The detachment sensors 308, 310 are provided to detect when tampering of the security tag occurs (e.g., a lanyard has been cut or a circuit has been shorted). When such detection is made, the security tag 300 performs one or more operations to notify store personnel that such tampering has occurred. These operations can include, but are not limited to, communicating a signal to a remote computing device via the EAS/RFID component, and/or outputting an alarm via an optional alarm circuit. In some scenarios, 6LoWPAN and Bluetooth are used as a network and user interface. The alarm may be an auditory alarm, a visual alarm or a vibrational alarm. The optional alarm circuit can be provided with the EAS/RFID component 306.

Figure 4:
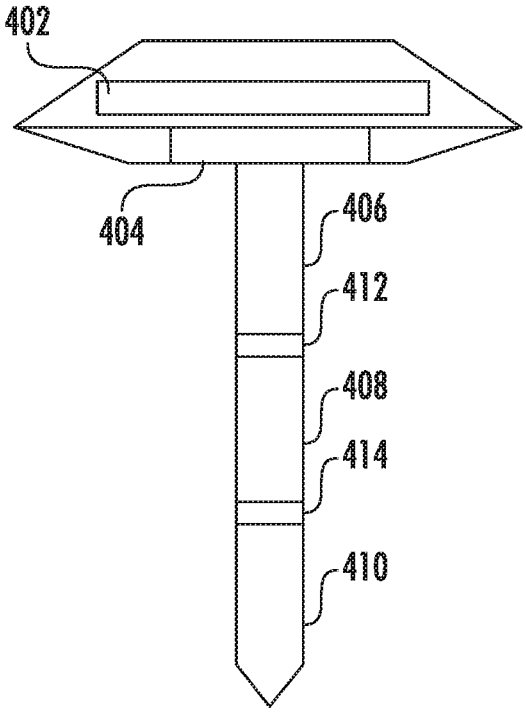
FIG. 4 is a front view of a tack assembly.

The tack assembly 304 has a tack head 316 and an elongate tack body 318 extending down and away from the tack head. As shown in FIG. 4, electronic components 402 and 404 are disposed within the tack head 316. The electronic component 402 comprises a battery. The electronic component 404 comprises a battery life monitoring circuit, a sensor circuit, an energy harvesting circuit, and/or an optional alarm circuit. The sensor circuit includes one or more environmental sensors (e.g., an ambient light sensor, a temperature sensor, a humidity sensor and/or a carbon dioxide sensor) and/or motion sensors (e.g., accelerometers, gyroscopes and/or vibration detection sensors). The energy harvesting circuit includes a capacitive storage element and/or a photovoltaic cell.

Notably, elongate tack body 318 is configured to electronically connect the electronic components 402, 404 disposed within the tack head 316 and the electronics component 306 disposed within the tag body 302. In this regard, the elongate tack body 318 comprises three conductive segments 406, 408, 410 separated from each other by two insulative segments 412, 414. Conductive segment 406 provides a means for communicatively connecting the electronic components 402, 404 to the EAS/RFID component 306. Conductive segment 408 provides a means for supplying power from battery 402 to the EAS/RFID component 306. Conductive segment 410 provides a means for providing a ground connection between the tag body 302 and the tack assembly 304. The electrical connections are achieved via electrical contacts 320 disposed within the tag body 302. Each electrical contact 320 contacts a respective conductive segment 406, 408 or 410 when the elongate tack body 318 is inserted into the tag body 302.

Figure 5:
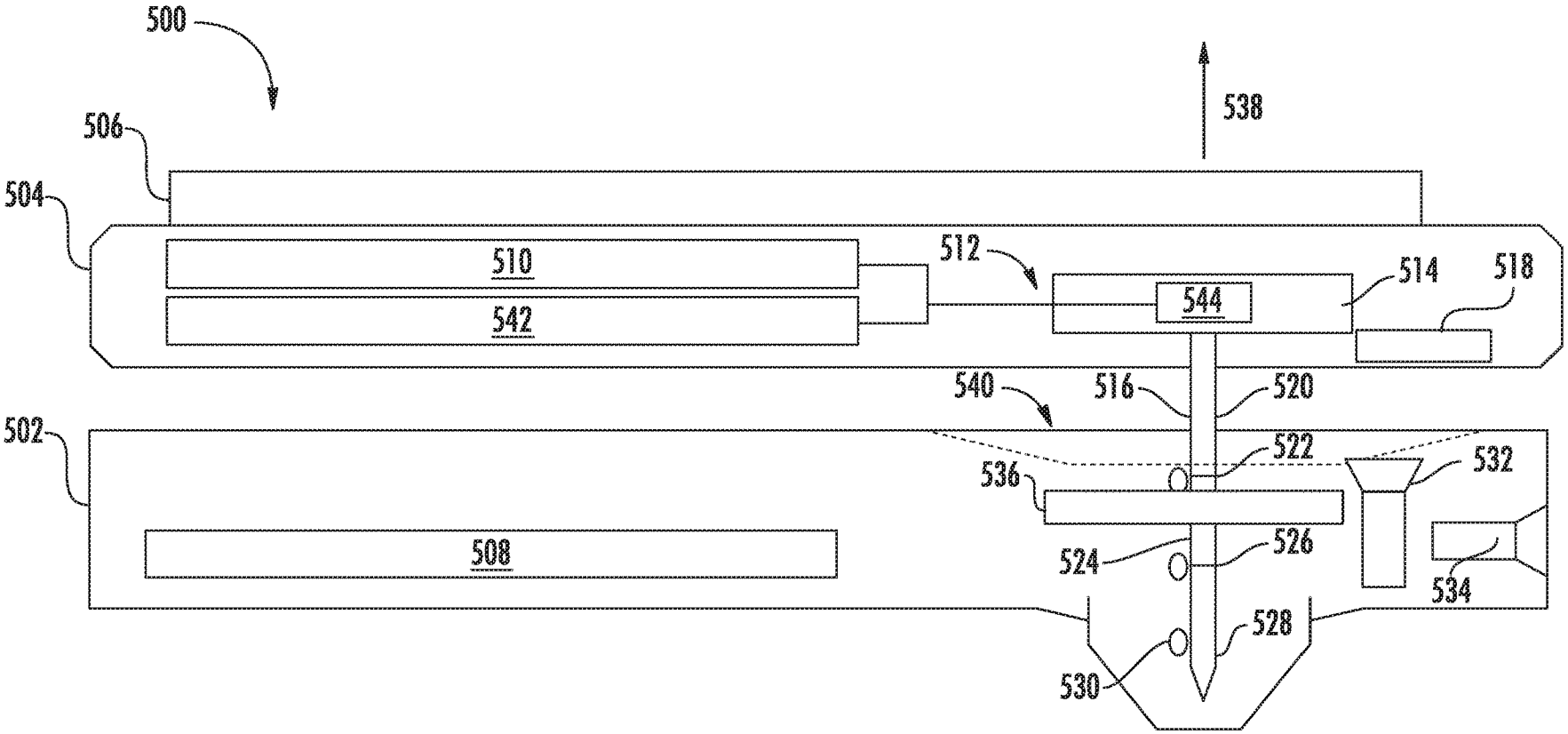
FIG. 5 is an illustration that is useful for understanding an exemplary security tag.

Referring now to FIG. 5, there is provided a schematic illustration of another exemplary security tag 500. Security tag 500 comprises a tag body 502 and a tack assembly 512. Similar to tack body 202 of FIG. 2, the tack assembly 512 is at least partially sized and shaped for insertion into and removal from an opening 540 formed in the tag body 502. A plurality of grooves (not shown in FIG. 3) may be formed along a length of the tack assembly 512 for engagement with a securement mechanism 536 disposed within the tag body 502. When the grooves are engaged by the securement mechanism 536, the security tag 500 is secured to an article (e.g., a piece of clothing). The invention is not limited in this regard. For example, in other scenarios the tack assembly does not have any grooves formed there along. As such, a magnetic securement mechanism (instead of a mechanical securement mechanism) is employed in this case.

An EAS/RFID component 508 is disposed within the tag body 502. EAS/RFID components are well known in the art, and therefore will not be described herein. Any known or to be known EAS/RFID component can be used herein without limitation. In all scenarios, the EAS/RFID component 508 comprises a transceiver, an antenna and/or a processor. For example, the EAS and RFID data, conditions and parameters can be defined and communicated by network communication through Bluetooth or other network module. In some scenarios, the tack assembly 512 and/or a lanyard (not shown in FIG. 5) may form part of the antenna for the EAS/RFID component 508.

Optional detachment sensors 532, 534 are also disposed within the tag body 502. The detachment sensors 532, 534 are provided to detect when tampering of the security tag is occurring (e.g., the cutting of a lanyard 750 or the shorting of a circuit). When such detection is made, the security tag 500 performs one or more operations to notify store personnel that tampering of the security tag has occurred. These operations can include, but are not limited to, communicating a signal to a remote computing device via the EAS/RFID component, and/or outputting an alarm via an optional alarm circuit. The alarm may be an auditory alarm, a visual alarm or a vibrational alarm. The optional alarm circuit can be included with the EAS/RFID component 508.

The tack assembly 512 has a tack head 514 and an elongate tack body 516 extending down and away from the tack head. As shown in FIG. 5, electronic components 504 and 506 are coupled to the tack assembly 512. Electronic component 504 includes one or more sensor circuits 510, an optional energy harvesting circuit 542, and a magnet 518. In some scenarios, at least a portion of the sensor circuit 510 and/or optional energy harvesting circuit 542 is(are) disposed within the tack head 514, rather than external to the tack head as shown in FIG. 5.

The sensor circuit includes, but is not limited to, at least one sensor, a transceiver, antenna and/or processor. The sensor comprises, but is not limited to, an environmental sensor (e.g., an ambient light sensor, a temperature sensor, a humidity sensor and/or a carbon dioxide sensor) and/or a motion sensor (e.g., accelerometers and/or gyroscopes). The sensor circuit is supplied power from a battery 544 disposed within the tack head, and communicates sensor data to a remote computing device via a wireless sensor network (e.g., a WiFi or RS232 based network).

The energy harvesting circuit 542 includes a capacitive storage element and/or a photovoltaic cell. The magnet 518 is provided to facilitate detecting when tampering of the tack assembly 512 occurs (e.g., the unauthorized pulling of the tack assembly in a direction 538 so as to be decoupled from the tag body 502). In some scenarios, the magnet 518 actuates a switch (not shown in FIG. 5) disposed within the tag body 502 so as to cause the issuance of an alarm. Electronic component 506 comprises a display or other output device (e.g., a light emitting diode, a speaker, and/or a vibration producing device).

Notably, elongate tack body 516 is configured to electronically connect the electronic components 506, 510, 542, 544 coupled to the tack assembly 512 and the electronics component 508 disposed within the tag body 502. In this regard, the elongate tack body 516 comprises three conductive segments 520, 524, 528 separated from each other by two insulative segments 522, 526. Conductive segment 520 provides a means for communicatively connecting the electronic components 506, 510, 542 and/or 544 to the EAS/RFID component 508. Conductive segment 524 provides a means for supplying power from battery 544 to the EAS/RFID component 508. Conductive segment 528 provides a means for providing a ground connection between the tag body 502 and the tack assembly 512. The electrical connections are achieved via electrical contacts 530 disposed within the tag body 502. Each electrical contact 530 contacts a respective conductive segment 520, 524 or 528 when the elongate tack body 516 is inserted into the tag body 502.

Figure 6:
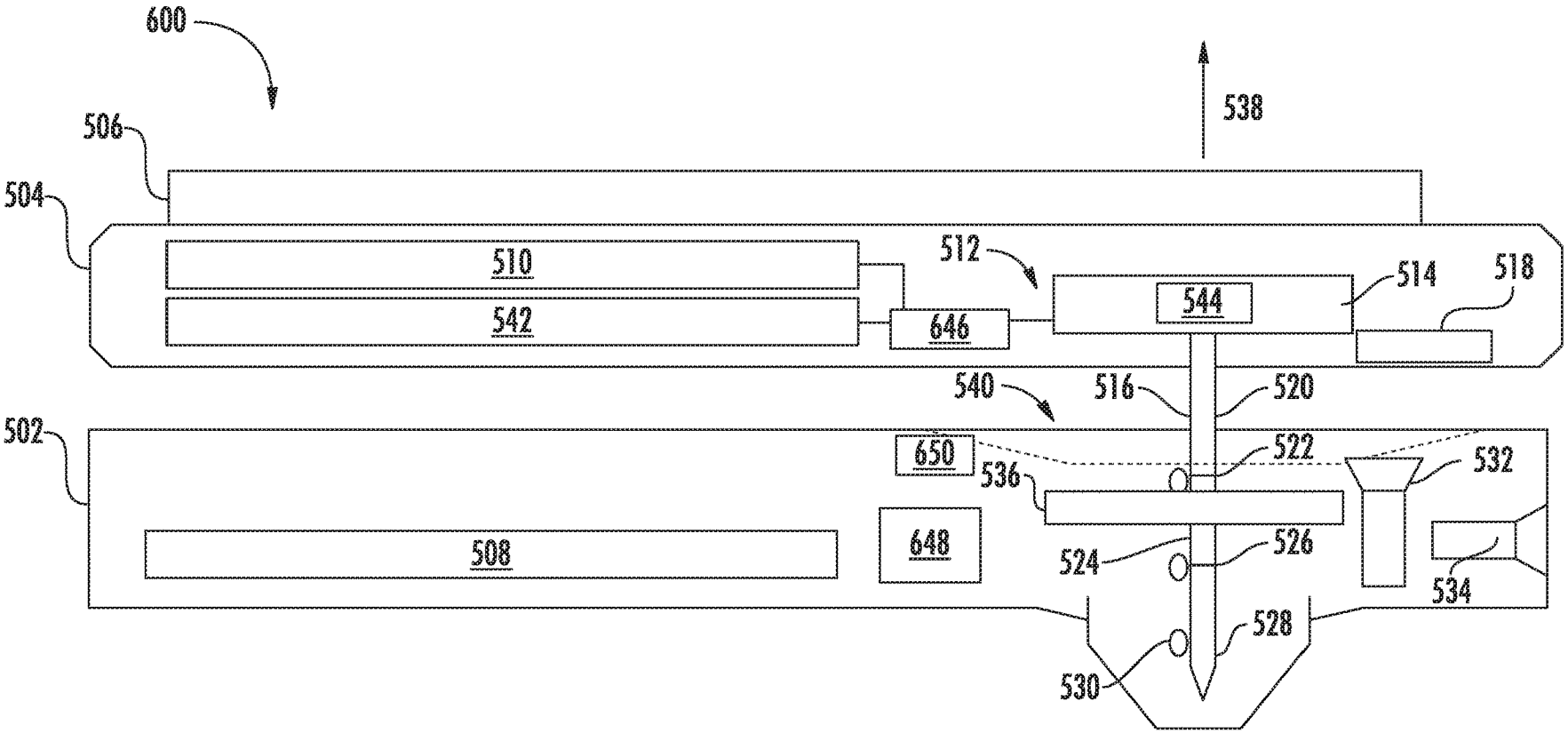
FIG. 6 is an illustration that is useful for understanding an exemplary security tag.

Referring now to FIG. 6, there is provided a schematic illustration that is useful for understanding another exemplary security tag 600. Security tag 600 is similar to security tag 500, albeit different in some ways. As such, the same reference numbers are used in FIG. 6 to indicate that the security tag 600 comprises some of the same components of security tag 500. For example, both security tags 500 and 600 comprise a tag body 502 and a tack assembly 512.

However, security tag 600 includes additional components which are not present in security tag 500. These components include an energy harvesting circuit 648 disposed within the tag body 502 and a switching element 646, 650 at least partially disposed within the tack assembly 504. The energy harvesting circuit 648 comprises a capacitive storage element for facilitating the detection of tampering and/or the communication of a signal from the EAS/RFID component 508 to a remote computing device subsequent to when the tack assembly 512 has been removed from tag body 502, i.e., subsequent to when battery 544 is no longer supplying power to the EAS/RFID component 508.

The switching element 646 provides a means to (a) create an open circuit between the battery 544 of the tack assembly 512 and at least the sensor circuit 510 when the tack assembly 512 is not coupled to the tag body 502, and (b) a closed circuit between the battery 544 of the tack assembly 512 and at least the sensor circuit 510 when the tack assembly 512 is coupled to the tag body 502. In this way, the switching element 646 provides power savings in relation to the battery. In some scenarios, the switching element 646 comprises a reed switch which is actuated via a magnet 650 and/or a pin (not shown) disposed in the tag body 502, i.e., the magnet and/or pin cause the position of the switching element 646 to transition from a closed position to an open position (or vice versa).

As an alternative to disconnecting the battery, the sensors of circuit 510 are disabled when not in communication with the electronics of tag body 502. Although the sensors will draw power from the battery 544, the sensor circuit would be placed in a standby mode or a low power mode. Power conservation is also implemented by disabling certain functions when the security tag 600 has been dormant for a period of time. Microprocessors implement power save options for this purpose. Sensors can be turned on and off as needed to conserve power. For example, the processor and all sensors, except for the accelerometer, can be turned off or placed in a low power mode. A processor can be re-enabled (or turned on) based on an interrupt or input from accelerometer motion causing the crossing of a given G-force threshold or movement. A capacitive touch sensor or other sensor can also provide this type of re-enablement.

Figure 7:
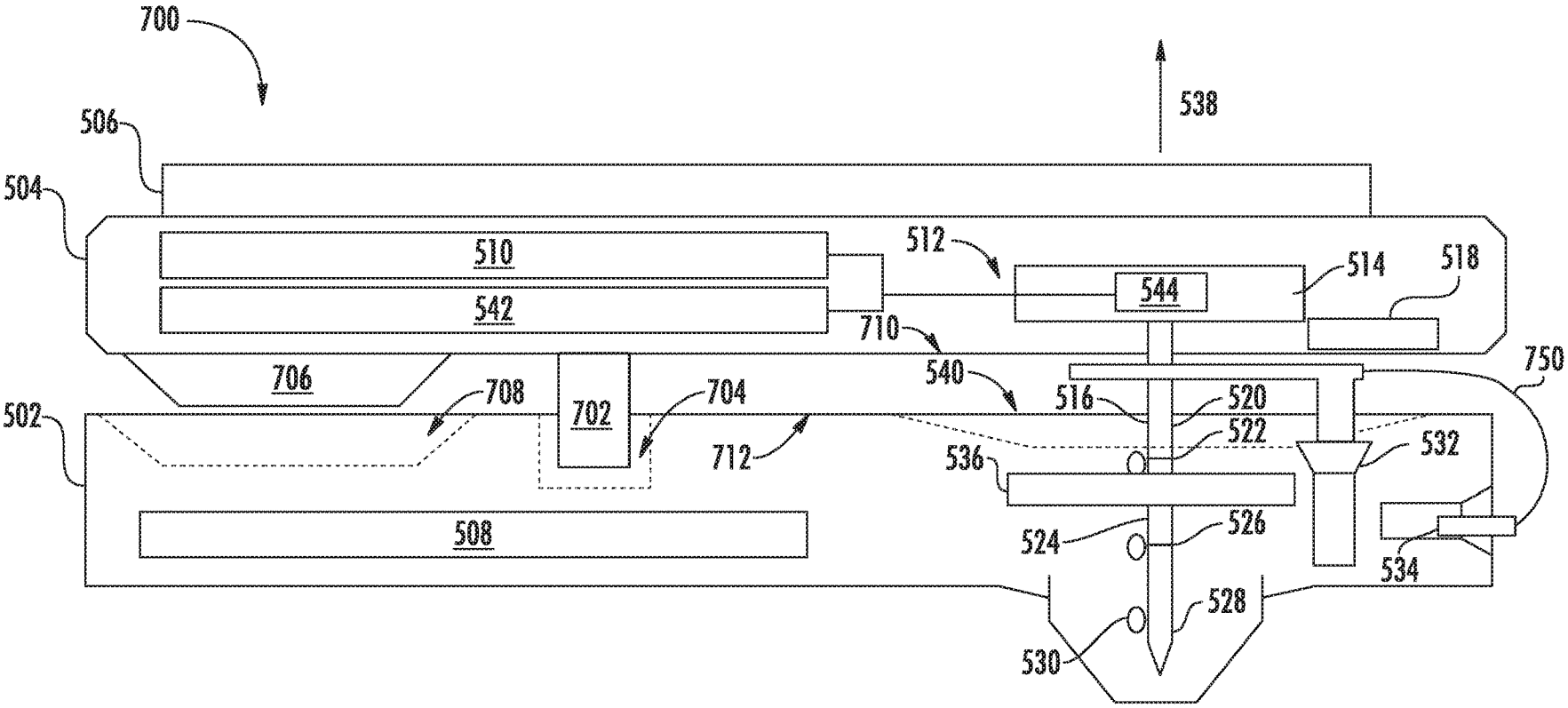
FIG. 7 is an illustration that is useful for understanding an exemplary security tag.

Referring now to FIG. 7, there is provided a schematic illustration that is useful for understanding another exemplary security tag 700. Security tag 600 is similar to security tag 500, albeit different in some ways. As such, the same reference numbers are used in FIG. 6 to indicate that the security tag 600 comprises some of the same components of security tag 500. For example, both security tags 500 and 600 comprise a tag body 502 and a tack assembly 512.

However, security tag 600 includes additional components which are not present in security tag 500. These components include projections 702, 706 and cavities 704, 708. The projections 702, 706 protrude out and away from a surface 710 of the electronic components 504. The cavities 704, 708 are formed in a surface 712 of the tag body 502. The projection 702 and cavity 704 are shaped and sized so as to mate with one another when the electronic component 504 is moved in proximity to the tag body 502. Similarly, the projection 706 and cavity 708 are sized and shaped so as to mate with one another when the electronic component 504 is moved in proximity to the tag body 502. The matting projections and cavities provide a means for relatively positional stability of the tag body 502 and the electronic component 504. In this regard, the mating projections and cavities prevent rotation of the tag body 502 and the electronic component 504 relative to each other when the tack assembly 512 is coupled to the tag body 502.

Notably, the present invention is not limited to the projection and cavity arrangement of FIG. 7. For example, in some scenarios only one projection/cavity pair is employed, rather than two projection/cavity pairs. Also, more than two projection/cavity pairs can be employed.

As evident from above, the novel approach described herein provides a tag body including a core controller (e.g., the EAS/RFID component) and tack assembly including select electronic components (e.g., sensors and/or battery). The electronic components of the tack assembly are selected based on the particulars of an application. This selective or modular arrangement of the security tag's electronic components facilitates the flexibility in the design and cost of the security tags. For example, a first person desires a security tag comprising only EAS/RFID functionality. In this case, the tag body is provided with the EAS/RFID component disposed therein, while a battery and battery monitoring circuit is disposed within the tack assembly. In contrast, a second person desires a security tag comprising EAS/RFID functionality as well as sensor network functionalities. In this case, the tag body is provided with the EAS/RFID component disposed therein, while a battery, battery monitoring circuit and sensor circuit are respectively disposed within or directly coupled to the tack assembly. In this way, the tack assembly is customizable to particular applications.

Figure 8:
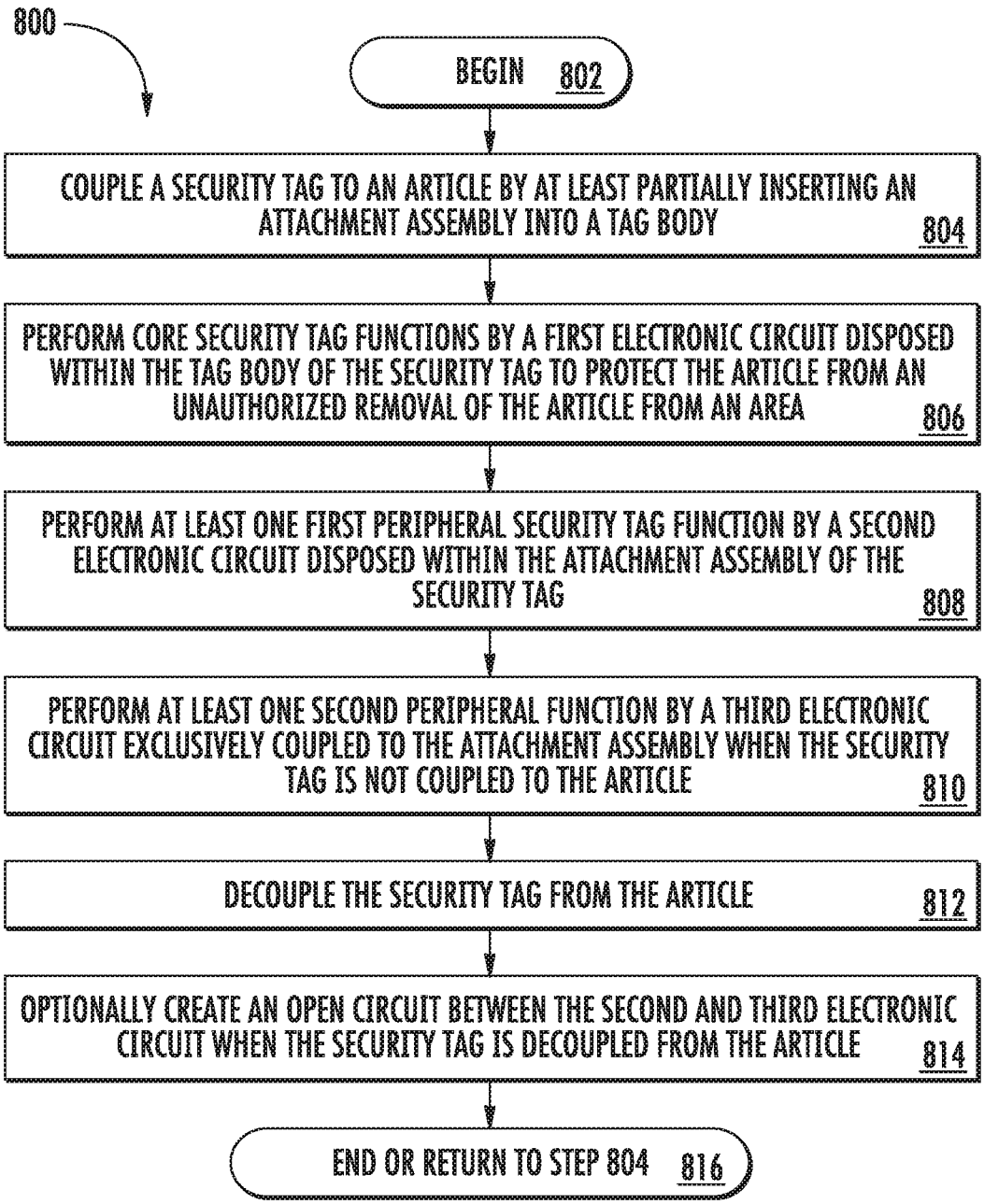
FIG. 8 is a flow diagram of an exemplary method for operating a security tag.

Referring now to FIG. 8, there is provided a flow diagram of an exemplary method 800 for operating a security tag (e.g., security tag 300 of FIG. 3, 500 of FIG. 5, 600 of FIG. 6 or 700 of FIG. 7). Method 800 begins with step 802 and continues with step 804 where the security tag is coupled to an article (e.g., article 114 of FIG. 1). This coupling is achieved by at least partially inserting an attachment assembly (e.g., tack assembly 304 of FIG. 3 or 512 of FIGS. 5-7) into a tag body (e.g., tag body 302 of FIG. 3 or 502 of FIGS. 5-7).

In a next step 806, core security tag functions are performed by a first electronic circuit (e.g., electronic circuit 306 of FIG. 3 or 508 of FIGS. 5-7) disposed within the tag body of the security tag. The core security tag functions are performed to protect the article from an unauthorized removal of the article from an area. The core security tag functions include, but are not limited to, EAS functions, RFID functions and/or tamper detection functions.

Thereafter in step 808, at least one first peripheral security tag function is performed by a second electronic circuit (e.g., circuit 402 of FIG. 4 or 544 of FIGS. 5-7) disposed within the attachment assembly of the security tag. In some scenarios, the first peripheral security tag function is selected from a plurality of peripheral security tag functions based on application-specific criteria. The application-specific criteria comprise cost of security tag fabrication, security tag disposability, security tag utilization flexibility, and/or security tag power saving capability. The plurality of peripheral security tag functions comprise at least one of power supply functions, power supply monitoring functions, sensor functions, sensor network transceiver functions, energy harvesting functions, user interface functions, alarm functions, and tamper detection functions.

Notably, the first and second electronic circuits are electrically connected to each other via an elongate tack body (e.g., elongate tack body 318 of FIG. 3 or 516 of FIGS. 5-7) extending down and away from a tack head (e.g., tack head 316 of FIG. 3 or 514 of FIGS. 5-7) of the attachment assembly. In this regard, the elongate tack body comprises a plurality of conductive segments (e.g., segments 406, 408, 410 of FIG. 4 and 520, 524, 528 of FIGS. 5-7) separated from each other by a plurality of insulative elements (e.g., segments 412, 414 of FIG. 4 and 522, 526 of FIGS. 5-7). Each conductive segment contacts a respective electrical contact of a plurality of electrical contacts (e.g., electrical contacts 320 of FIG. 3 and 530 of FIGS. 5-7) disposed within the tag body so as to establish an electrical connection between the first and second electronic circuits.

Referring again to FIG. 8, method 800 continues with step 810. Step 810 involves performing at least one second peripheral function by a third electronic circuit (e.g., electronic circuit 510 and/or 542 of FIGS. 5-7). Notably, the third electronic circuit is exclusively coupled to the attachment assembly when the security tag is not coupled to the article.

Subsequently, the security tag is decoupled from the article, as shown by step 812. Notably, an open circuit is optionally created between the second and third electronic circuits when the security tag is decoupled from the article, as shown by step 814. In this regard, it should be understood that a closed circuit between the second and third electronic circuits when the security tag is coupled to the article. Thereafter, step 816 is performed where method 800 ends or returns to step 804.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

We claim:

1. A security tag, comprising:

a tack assembly including a tack head having a elongate pin portion extending therefrom, one or more portions of the elongate pin being formed from a conductive material to provide one or more discrete conductive segments, the tack head further comprising one or more electronic components disposed therein, the one or more electronic components being coupled, via one or more electronic circuits disposed in the tack head, to at least one of the one or more conductive segments of the elongate pin, the one or more electronic components disposed in the tack head including at least one of a battery and an energy harvesting circuit;

a tag body, the tag body having disposed therein one or more electronic components coupled to at least one electrical circuit within the tag body, the tag body further comprising an aperture configured to receive a portion of the elongate pin in a locking arrangement in which the elongate pin is inserted into an interior cavity of the tag body, the electrical circuit in the tag body being configured to align and electrically couple with the one more conductive segments of the elongate pin when the elongate pin is inserted into the tag body, and a switching element disposed in the tack head which is operable to open the at least one circuit between the battery and at least one sensor circuit disposed in the tack head when the tack head is not electrically coupled to the tag body, the switching element being actuatable by a magnet disposed in the tag body.

2. The security tag of claim 1, wherein the one or more one electronic components disposed in the tag body include and at least one of an Electronic Article Surveillance ("EAS") component and a Radio Frequency Identification ("RFID") component.

3. The security tag of claim 1, wherein at least one of the one or more electronic components disposed in the tag body are powered at least in part by the battery disposed in the tack head.

4. The security tag of claim 1, wherein at least one of the one or more electronic components disposed in the tag body and at least one of the one or more electronic components disposed in the tack head are powered at least in part by the energy harvesting circuit.

5. The security tag of claim 1, wherein one of the conductive segments provides a ground connection between the respective electrical components of the tag body and the tack head.

6. The security tag of claim 1, wherein the one or more electronic components disposed in the tack head include a communications module operable to transmit data via a wireless sensor network.

7. The security tag of claim 1, wherein the one or more electronic components disposed in the tag body include a communications module operable to transmit data via a wireless sensor network.

8. The security tag of claim 1, wherein the tag body includes one or more sensor circuits.

9. The security tag of claim 8, wherein the sensor circuit includes at least one of a sensor, a processor, a transceiver, and an antenna.

10. The security tag of claim 9, wherein the sensor comprises an environmental sensor.

11. The security tag of claim 10, wherein the environment sensor is at least one of an ambient light sensor, a temperature sensor, a humidity sensor, and a carbon dioxide sensor.

12. The security tag of claim 9, wherein the sensor comprises a motion sensor.

13. The security tag of claim 9, wherein the sensor comprises a tamper detection sensor.

14. The security tag of claim 13, wherein the tag body includes an alarm module coupled to the tampering detection sensor.

15. The security tag of claim 13, wherein the alarm module includes at least one of an audible alarm circuit, a visual alarm circuit, or vibrational alarm circuit.

16. The security tag of claim 13, wherein the alarm module is coupled the wireless communication.

17. The security tag of claim 1, wherein the tag body includes an acousto-magnetic EAS element disposed therein.

* * * * *